United States Patent [19]

Claassen

[11] Patent Number: 4,905,867

[45] Date of Patent: Mar. 6, 1990

[54] DISPENSER FOR SOLID PHARMACEUTICS AND EDIBLE ARTICLES

[76] Inventor: Henning J. Claassen, Industriegebiet Hafen, 2120 Lüneburg, Fed. Rep. of Germany

[21] Appl. No.: 208,622

[22] Filed: Jun. 20, 1988

[30] Foreign Application Priority Data

Jun. 25, 1987 [DE] Fed. Rep. of Germany ..... 3721016

[51] Int. Cl.[4] ..... G07F 11/72

[52] U.S. Cl. ..... 221/30; 221/279; 221/250

[58] Field of Search ..... 220/93, 339; 453/53; 401/50, 88; 312/61, 71; 221/30–32, 279, 280, 227–230, 2, 4, 250

[56] References Cited

U.S. PATENT DOCUMENTS

| | | | |
|---|---|---|---|
| 381,266 | 4/1888 | Miller | 312/71 |
| 1,891,682 | 12/1932 | Meyer | 401/50 |
| 1,917,480 | 7/1933 | Widing | 312/71 |
| 1,973,903 | 9/1934 | King | 312/71 |
| 2,935,180 | 5/1960 | Martens et al. . | |
| 3,195,772 | 7/1965 | Buttery | 221/33 |
| 3,228,556 | 1/1966 | Nonestied | 221/279 |
| 3,591,043 | 7/1971 | Murphy . | |
| 3,838,791 | 10/1974 | Raitt | 221/30 |
| 3,937,389 | 2/1976 | Wind | 220/339 |
| 4,174,048 | 11/1979 | Volpe, Jr. . | |
| 4,295,579 | 10/1981 | Hass . | |

FOREIGN PATENT DOCUMENTS

| | | |
|---|---|---|
| 166326 | 7/1950 | Austria . |
| 214350 | 3/1961 | Austria . |
| 1039705 | 9/1958 | Fed. Rep. of Germany . |
| 1536155 | 12/1969 | Fed. Rep. of Germany . |
| 1913500 | 9/1970 | Fed. Rep. of Germany . |

*Primary Examiner*—H. Grant Skaggs

*Attorney, Agent, or Firm*—Armstrong, Nikaido, Marmelstein, Kubovcik & Murray

[57] ABSTRACT

A dispenser for solid pharmaceutics and edible articles comprises a container with side walls and a removal opening, a lid pivotally connected to the container for closing the removal opening and a bottom of the container displaceable in the direction towards the removal opening; the bottom is connected through a slot guide in a side wall of the container to an actuating element at the outer side of the container said slot guide being closed before use and separable on use.

14 Claims, 2 Drawing Sheets

18
14
16
10
12
20
24

18
14
26
10
24

18
24
10
14
26
20
23
23

24
18
22
10
12
14
23

DISPENSER FOR SOLID PHARMACEUTICS AND EDIBLE ARTICLES

BACKGROUND OF THE INVENTION

1. Field of the Invention

The invention relates to a personal size, handheld dispenser for solid pharmaceutics, foodstuffs, edible articles, tablets and the like comprising a container having side walls and a removal opening, a lid connected pivotally to the container for closing the removal opening and a bottom of the container displaceable in the direction towards the removal opening.

2. Description of the Prior Art

Although such a dispenser can fundamentally also be used for dispensing "pourable" agents, intended in particular is the dispensing of pill or tablet-like preparations, for example disc-shaped, right-parallelepipedic or cubic dragées, or also tablets with corresponding shape.

In particular disc-shaped tablets are packed in a cylindrical container which can be sealed by means of a screw lid or cover. The removal of the tablets is correspondingly complicated because the screwing movement necessary for removing the cover requires the use of both hands.

The peppermint dragées sold, for example, under the name "VIVIL" are packed in a personal size imprinted foil package which after the opening and removing of the first dragée can be provisionally closed again only by pressing its opened end together and therefore has an unattractive appearance. There is also the danger of the entire content dropping out of the foil package; finally, the clean dust-free reclosure of this package is not possible.

A further embodiment of a personal size, hand-held dispenser for solid pharmaceutics end edible articles is used for the dragées sold under the name "Tic-Tac" and comprises a container having a bottom and side walls and a lid connected pivotally to the container.

Said lid or cover is formed integrally with the upper part of the container and can be pivoted upwardly so that individual dragées can be taken from the dispensing opening then exposed. This box-shaped dispenser is admittedly more hygienic than a pure foil package but has the disadvantage that the handling is relatively difficult and impracticable because the individual dragées must be "shaken out" through the relatively narrow opening. In addition, after removal of the first dragée the interior space of the container is no longer completely filled so that the remaining dragées can move in the interior space of the container, which is now too large, and "rattle". The noise thereby developed is particularly unpleasant when rigid plastic is used for the container.

This free movement of the articles and the resulting noise development also occur by the way with the usual can-shaped containers for tablets; it has also the disadvantage that the sensitive brittle articles can be damaged or even destroyed by the vibrations and shocks in the free movement.

Finally, personal size, hand-held dispenser for solid pharmaceutics and edible articles of the aforementioned type are disclosed in Austrian patents 166,326 or 214,350 and comprises a container having side walls and a removal opening, a lid connected pivotally to the container for closing the removal opening and a bottom of the container displaceable in the direction towards the removal opening. The bottom is biased by a spring upwardly in the direction towards the lid so that the uppermost article, for example lozenges, tablets, sweets, cigarettes or the like, are held by a stop provided at the upper end of the container casing. The lid comprises an advancing member which on opening of the lid pressure laterally against the article and pushes the latter forwardly transversely of the container axis over the container edge so that said article can be gripped by the lips and thereby reaches the mouth in hygienically satisfactory manner (Austrian patent 166,326).

A similar constructional form is disclosed in Austrian patent 214,350, the advancing element being formed by a spring-biased tongue which after the advance or ejection of the uppermost article in the pivoted-out position engages the remaining stack, or, if all the articles have already been ejected, the bottom of the container under pressure; by means of which with the now predominant spring force of the tongue the respective article to be ejected is completely relieved of the effect of the pressure spring effecting the advance of the articles.

A disadvantage in these known dispensers is the relatively complicated structure with the additional advancing element; in addition, it is not possible to recognise the filling level of the container from the outside; finally, it is not ensured with the desired certainty that the content of the container is protected from outside influences and thus stored satisfactorily from the point of view of hygiene.

SUMMARY OF THE INVENTION

The object of the invention is thus to provide a dispenser for solid pharmaceutics and edible articles of the type indicated in which the aforementioned disadvantages do not occur.

More particularly, a dispenser is to be provided in which each individual tablet or the like can be easily removed by means of a single manipulation without any complicated mechanical construction being necessary; it is to be ensured at the same time that the remaining tablets or the like are held hygienically and reliably in a defined position, i.e. that the "rattling" previously frequently inevitable is eliminated. Finally, it is also to be possible to recognise immediately from the outside when the container has already been opened.

The invention therefore proposes in a dispenser for solid pharmaceutics and edible articles comprising a container having side walls and a removal opening, a lid connected pivotally to the container for closing the removal opening and a bottom of the container displaceable in the direction towards the removal opening, the improvement that the bottom is connected through a slot guide in a side wall of the container to an actuating element at the outer side of the container said slot guide being closed before use and separable on use.

Expedient embodiments are defined by the features of the subsidiary claims.

The advantages achieved with the invention are due to the use of a substantially sealed, dust-tight plastic container in which the tablets or the like can be stored in hygienically satisfactory manner protected from external interference.

The upper dispensing end of the container is sealed by a pivotally attached lid which in accordance with a preferred embodiment is made integrally with the container so that the container and lid may be made by means of a single injection operation from a suitable plastic, for example polyethylene or polypropylene, or also from drawn aluminium.

Arranged in the container is a slide which serves as bottom and the dimensions of which are adapted exactly to the internal dimensions of the container so that the slide can be displaced in the container bearing on the inner faces of the side walls thereof. This in turn means that the container at least over the movement range of the slide has the same cross-sectional form and the same cross-sectional area.

The slide is connected via a narrow web to an actuating element which is disposed outside the container. The web and thus the slide are guided in a slot in a side wall of the container so that when the slide is pushed up from the outside the tablets or the like disposed in the container are accordingly entrained and can be dispensed from the container with the lid open.

The container can have the form of a right parallelepiped, a cube or cylinder; the essential point, as mentioned, is only that its cross-sectional form does not change in the direction of movement of the slide.

The lower edges of the side walls of the container should be provided with inwardly projecting seals on which the slide bears in its lower position and thus seals said region.

Also, the engagement between the side walls of the slide and the inner face of the container should be such that adequate friction results which is able to hold the slide in the position into which it has been brought by external actuation even under vibrations of the dispenser.

Thus, the volume of the container, which is still filled with the remaining tablets or the like, is continuously always reduced so that the tablets or the like can be kept in a predetermined position and cannot move freely. The troublesome "rattling" of dragées or tablets is thus eliminated as is any danger of dmage.

It is in principle possible to provide the side wall of the container with a slot via which the web of the slide is guided. The two edges of the slot or slit can bear closely on each other with biasing to ensure a certain dust tightness here as well.

If, however, higher demands are made on the hygienic maintanence of the dispenser content at least the part of the slot at the level of the remaining tablets or the like should still be completely and reliably sealed.

There are two possibilities for solving this problem, firstly the formation of a longitudinal predetermined breakage point in the corresponding side wall of the container which can be slit open by means of the web between the actuating member and the slide. Thus, when the slide is pushed upwardly the blade-like narrow web slits said predetermined breakage point open so that a slit arises along the movement path of the slide which has been covered, said slit however still being sealed in the remaining portion of the container.

As an alternative to this it is possible to make the corresponding side wall of the container with a slot or slit and cover said slot from the inside or outside with a laminated-on sheet or foil. Said foil can easily be cut by the web between the actuating member and the slide.

Such a foil should cover not only the container but also the lid so that a possible solution is to cover the entire outer surface of such a dispenser with a foil and thereby hygienically seal it in dust-tight manner. This also has the advantage that any manipulation of the dispenser can immediately be detected on purchase because it would result in damage to the outer foil. Such a dispenser is thus tamperproof, i.e. guaranteed against external interference, as is important due to the sometime occurring blackmail attempts based on the manipulation of such dispensers.

Such a dispenser has an automatic "level indicator" because from the position of the external actuating element it is possible to detect immediately the position of the slide and thus the remaining contents of the dispenser.

According to a preferred embodiment the upper edge of the container is somewhat bevelled so that the lid extends inclined downwardly. On movement of the slide upwardly the remaining tablets, lozenges or dragées are pressed from beneath against the inclined lid so that the latter opens automatically. To do this only a single manipulation is necessary, i.e. that of the actuating element of the slide.

The form of the lid is adapted to the upper end of the container in such a manner that a self-closing closure results which seals the container in dust-tight and thus hygienic manner.

The container may be filled as required either via the open lid or via the bottom which is either subsequently sealed or formed by the inserted slide as is the case according to a preferred embodiment.

BRIEF DESCRIPTION OF THE DRAWINGS

The invention will be described hereinafter in more detail with the aid of an example of embodiment with reference to the accompanying schematic drawings, wherein.

DESCRIPTION OF THE PREFERRED EMBODIMENT

Figure 1:
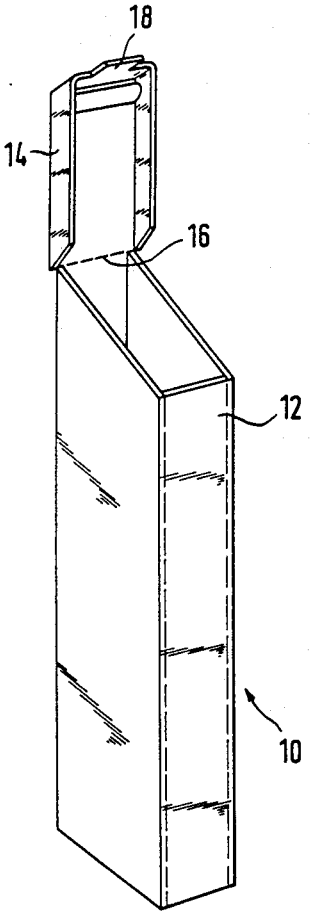
FIG. 1 shows a perspective view of the container with open lid.

The dispenser denoted generally by the reference numeral 10 has a substantially right-parallelepipedic housing 12 (cf. FIG. 1) which is connected integrally and articulately to a pivot lid 14. The upper edge of the container 12 (cf. FIG. 1) is somewhat inclined so that in the closed state a corresponding inclined position of the lid 14 results.

With the right-parallelpipedic form of the container 12 illustrated the actual lid face of the lid 14 is of rectangular shape and is provided with three downwardly projecting webs which bear in the closed state from the outside on the corresponding side walls of the container 12 and thereby seal the latter reliably and hygienically.

The pivot connection between the lid 14 and container 12 is formed by a linear thinning of the corresponding wall indicated in FIG. 1 by a dashed line 16 so that the lid 14 can be pivoted about said "pivot axis".

At its web opposite the pivot axis 16 the lid 14 is formed with a short projection 18 which can be gripped by hand and used for opening and closing the lid 14.

Figures 4, 5, 6, 7:
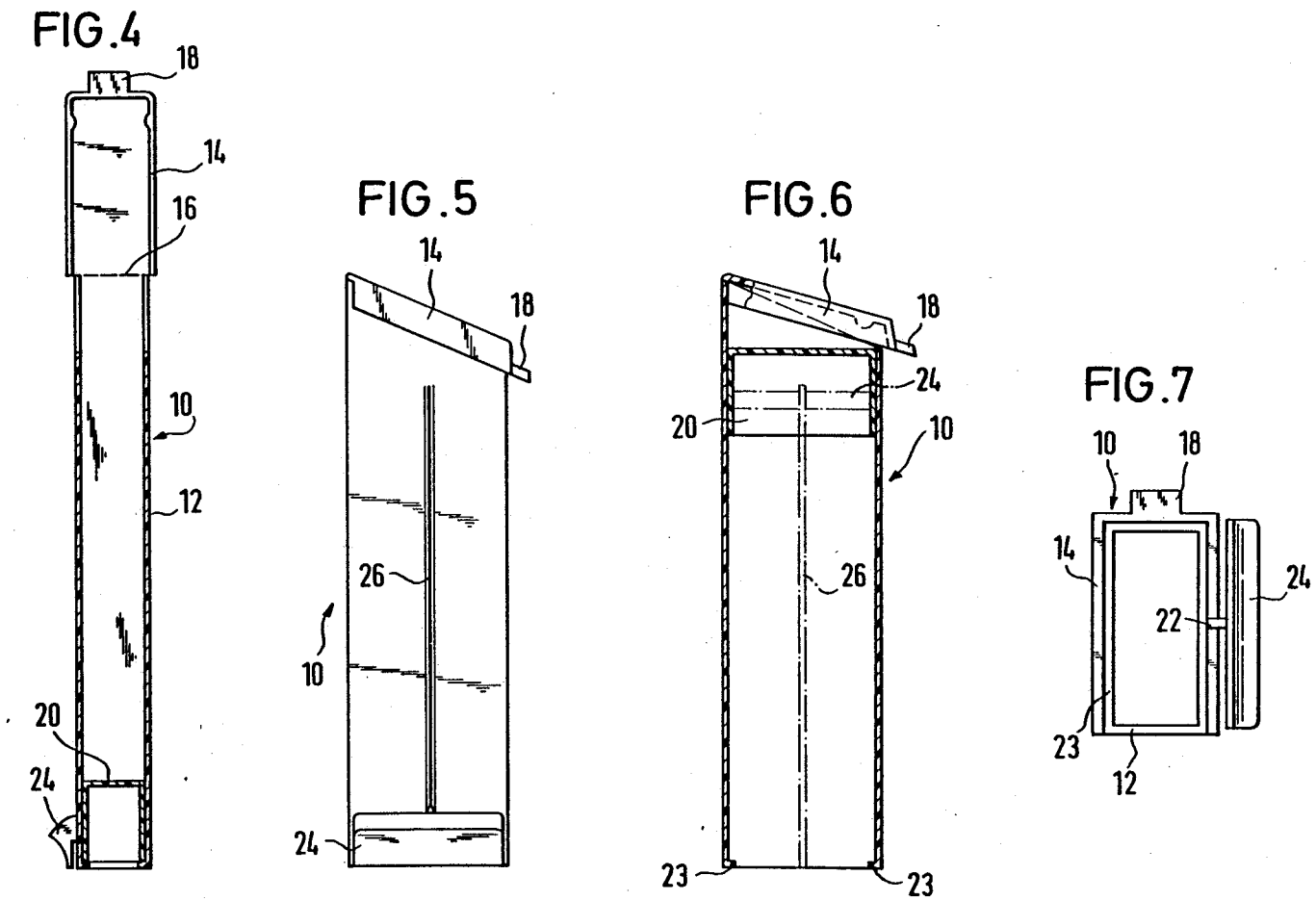
FIG. 4 is a section along the line IV—IV of FIG. 3 through a dispenser with the lid open and with the slide in its lower position.
FIG. 5 is a view of a side of the dispenser with the actuating element of the slide.
FIG. 6 is a side view of the dispenser with the slide in its uppermost position and FIG. 7 is a view of the dispenser from below.

As apparent in FIG. 6 the lower end of the container 12 is open and is sealed by a slide 20 still to be explained. The lower edges of the side walls have inwardly directed projections 23 which can be seen in FIG. 6 and serve as support for the slide 20 which performs the function of the bottom for the container 12.

As an alternative, it is also possible to make the container 12 with a bottom rigidly connected to the side walls.

The slide 20 is adapted to the cross-sectional form of the container 12 and has a right-parallelepipedic shape with dimensions such that the outer walls of the slide 20 engage firmly the inner walls of the container 12 so that the force of the resulting frictional engagement keeps the slide 20 in a defined position.

The slide 20 is connected via a narrow web 22 convering to a blade at the top in knife-like manner to an actuating element 24 which has a rounded outer face which can be engaged by a finger and displaced.

Figure 2:
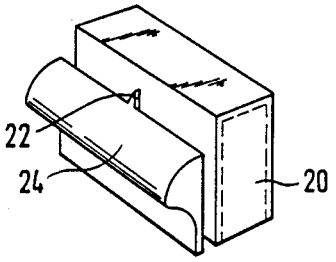
FIG. 2 is a perspective view of the slide with its actuating element.
Figure 3:
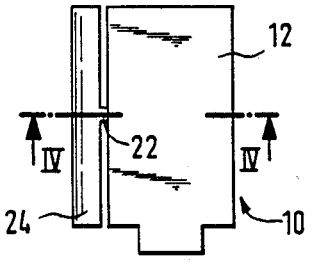
FIG. 3 is a view from above of the dispenser and the actuating element of the slide.

As indicated in FIG. 2 the slide 20 may have either the form of a solid right parallelepiped or, for example to save weight and material, be formed as hollow downwardly open box.

The integral component comprising the slide 20 and actuating element 24 is guided by means of the web 22 in a slot 26 in a side wall of the container 12. Various embodiments are available for this purpose.

It is for example possible to provide the container 12 in its production with such a slit or slot 26 and to make the two portions of the corresponding side wall such that the two edges of the slit bear on each other with slight pressure and are spread apart only by the blade-like web 22 when the slide 20 is moved upwardly in the container 12.

Alternatively, the corresponding side wall may also be provided with a linear predetermined breakage point which on the movement of the slide 20 is slit open by means of the blade-like web 22.

Finally, the slot 26 formed in the production of the container 12 can be covered on the inside or outside with a thin laminated-on foil which is also slit open by the blade-like web 22 so that free movement of the slide in the vertical direction in the container 12 is possible.

FIGS. 4 and 5 show the slide 20 with the actuating element 24 in its lower position serving as bottom of the container. The container 12 may now for example be filled with the lid open. Finally, the lid 14 is closed and for example sealed with a foil.

The content of the container, i.e. lozenges, dragées, tablets or similar pharmaceutics and edible articles, are thus sealed from the outside by the container 12 on the one hand and the lid 14 or slide 20 on the other.

To open the dispenser 12 the cover foil is removed and the lid 14 swung away upwardly either by means of the projection 18 or by pushing up the slide 20 in the container 12. For, as is apparent from FIG. 6, by the movement of the slide 20 upwardly the contents of the container 12 are also pressed upwardly and first come to bear on the side of the lid 14 remote from the pivot axis 16 thereof; the resulting torque swings the lid 14 upwardly so that generally the movement of the slide 20 suffices for the simultaneous opening of the lid 14.

By the movement of the slide 20 upwardly, the remaining contents of the dispenser 10 always occupy only a minimum space defined by the lid 14 and the slide 20 until finally the slide 20 has reached the upper position shown in FIG. 6 and the dispenser 12 has thus been completely emptied.

The container 12 and slide 20 with actuating element 24 may either be made from a plastic, in particular polyethylene and polypropylene, or from drawn aluminium parts.

If required the slide 20 can be provided with additional lip seals, this being done in the region of its lower end to be sealed from below and/or from the side as a seal with respect to the slot 26.

Hitherto a dispenser 10 with rectangular container 12 has been described; the container 12 may however have a cubic shape or a cylindrical shape as generally employed for tablet cans or boxes.

As apparent from FIG. 2 the blade-like web 22 of the slide 20 is somewhat set back so that any covering foil present is slit open "offset". This ensures that the dragées still present in the container remain perfect from the hygiene point of view and cannot be soiled.

I claim:

1. A dispenser for small solid pharmaceutics and edible articles comprising:
   (a) a container having side walls and a removal opening at an upper end thereof, said upper end of said container being formed at a bevel,
   (b) a lid connected pivotally to to said beveled upper end of said container for closing the removal opening and
   (c) a bottom of the container displaceable in a direction towards the removal opening,
   wherein
   (d) the bottom is connected through a slot guide in a side wall of the container to an actuating element at the outer side of the container, said slot guide is closed before use and separable upon movement of said actuating element and upward movement of the contents of said container will cause said contents to contact said lid and cause said lid to pivot to an open position.

2. A dispenser according to claim 1, wherein the bottom is connected via a blade-like web to the actuating element.

3. A dispenser according to claim 2, wherein the bottom, the blade-like web and the actuating element are formed integrally.

4. A dispenser according to claim 1, wherein said dispenser is a personal size dispenser adapted to be held in one hand and said actuating element includes a curved outer face serving as an engagement face for a finger.

5. A dispenser according to claim 1, wherein the container is made integrally with the lid.

6. A dispenser according to claim 1, wherein the pivot axis between the container and the lid is formed by a weakened zone in a side wall of the container.

7. A dispenser according to claim 1, wherein the bottom has a shape adapted to the shape and the dimensions of the container and bears sealingly on the inner walls of the container.

8. A dispenser according to claim 1, wherein said slot guide is covered sealed on the inside or outside by a laminated-on sheet or foil.

9. A dispenser according to claim 1, wherein said bottom is connected to said actuating element by a web and said slot guide is comprised of a linear weakened zone adapted to be slit open by the web.

10. A dispenser according to claim 1, wherein the lower edges of the side walls of the container have inwardly directed projections serving as support for the bottom.

11. A dispenser for small solid pharmaceuticals and edible articles comprising:

a container having a tapered upper end and a removal opening at said upper end, a lid pivotally connected to said tapered upper end of said container for closing the removal opening, a movable bottom of the container displaceable in a direction toward the removal opening, a guide slot in a side wall, an actuating element external of said side wall, a web movable in said guide slot and connecting said actuating element to said movable bottom, and a sheet secured to said sidewall and sealing said guide slot between said web and said removal opening, whereby movement of said actuating element and web will progressively open said sheet seal as said movable bottom is displaced toward the removal opening and movement of the contents of said container will contact said lid and cause said lid to pivot to an open position.

12. A dispenser according to claim 11 wherein said web converges to a cutting edge and said sheet seal is opened by said cutting edge of said web.

13. A dispenser for small solid pharmaceuticals and edible articles comprising:

a container having a tapered upper end and a removal opening at said upper end, a lid pivotally connected to said tapered upper end of said container for closing the removal opening, a movable bottom of the container displaceable in a direction toward the removal opening, a linear weakened zone in said side wall and extending from a location adjacent said removal bottom toward said removal opening, an actuating element external of said side wall, and a web extending through said linear weakened zone of said side wall and connecting said actuating element to said movable bottom, whereby movement of said actuating element and web will progressively open said linear weakened zone as said movable bottom is displaced toward the removal opening and movement of the contents of said container will contact said lid and cause said lid to pivot to an open position.

14. A dispenser according to claim 13 wherein said web converges to a cutting edge and said linear weakened zone is opened by said cutting edge of said web.

* * * * *